US010038278B2

(12) United States Patent
Lane et al.

(10) Patent No.: US 10,038,278 B2
(45) Date of Patent: Jul. 31, 2018

(54) ELECTRICAL CONNECTOR HAVING A CONNECTOR POSITION ASSURANCE ELEMENT

(71) Applicants: TE CONNECTIVITY CORPORATION, Berwyn, PA (US); TYCO ELECTRONICS BRASIL LTDA, Braganca Paulista (BR)

(72) Inventors: David James Lane, Hummelstown, PA (US); James Michael Raudenbush, Halifax, PA (US); Douglas John Hardy, Middletown, PA (US); Christian Perry Brandt, York, PA (US); Neil Franklin Schroll, Mount Joy, PA (US); Dominic Anthony Farole, Hummelstown, PA (US); Fabio Fortunato Christiano, São Paulo (BR); Ednei Lopes, São Paulo (BR); Nicholas Lee Evans, Harrisburg, PA (US)

(73) Assignees: TE CONNECTIVITY CORPORATION, Berwyn, PA (US); TYCO ELECTRONICS BRASIL LTDA, Braganca Paulista (BR)

( * ) Notice: Subject to any disclaimer, the term of this patent is extended or adjusted under 35 U.S.C. 154(b) by 0 days.

(21) Appl. No.: 15/459,799

(22) Filed: Mar. 15, 2017

(65) Prior Publication Data

US 2017/0271815 A1 Sep. 21, 2017

Related U.S. Application Data

(63) Continuation-in-part of application No. 15/073,149, filed on Mar. 17, 2016, now Pat. No. 9,680,256.

(51) Int. Cl.
*H01R 13/627* (2006.01)
*H01R 13/629* (2006.01)
*H01R 13/641* (2006.01)

(52) U.S. Cl.
CPC ... *H01R 13/62927* (2013.01); *H01R 13/6272* (2013.01); *H01R 13/641* (2013.01)

(58) Field of Classification Search
CPC ..... H01R 13/639; H01R 13/6272
(Continued)

(56) References Cited

U.S. PATENT DOCUMENTS 5,681,178 A * 10/1997 Kunkle ..... H01R 13/641 439/352
6,435,895 B1 8/2002 Fink et al.
(Continued)

FOREIGN PATENT DOCUMENTS

EP 1592094 A1 11/2005
JP 2004079206 A 3/2004

*Primary Examiner* — Neil Abrams

(57) ABSTRACT

An electrical connector includes a housing having an upper wall and a first protrusion and a CPA element slidably coupled to the housing along the upper wall between an extended position and an inserted position. The CPA element includes a base and a first beam extending from the base having a first arm and a first finger including an abutment wall configured to abut against the first protrusion and a tip configured to be engaged by a mating connector when received in the housing. The tip is deflected from a blocked position to a released position with the distal end engaging the protrusion in the blocked position and the tip being deflected outside of the protrusion to the released position where the tip is able to clear past the protrusion to allow the CPA element to be moved from the extended position to the inserted position. The CPA may be configured so that in the extended position it is to block release of a pivotal latch used to retain the connector to a mating connector.

20 Claims, 7 Drawing Sheets

(58) Field of Classification Search
USPC ..... 439/352, 489
See application file for complete search history.

(56) References Cited

U.S. PATENT DOCUMENTS

| | | | | |
|---|---|---|---|---|
| 6,468,105 | B2 * | 10/2002 | Noguchi | H01R 13/4367 439/352 |
| 6,491,542 | B1 | 12/2002 | Zerebilov | |
| 6,780,045 | B2 | 8/2004 | Shuey et al. | |
| 7,048,568 | B2 * | 5/2006 | Fisher | H01R 13/6272 439/352 |
| 7,326,074 | B1 | 2/2008 | Lim et al. | |
| 7,347,745 | B1 | 3/2008 | Raudenbush et al. | |
| 7,544,081 | B2 | 6/2009 | Lim | |
| 7,762,854 | B1 | 7/2010 | Peng | |
| 8,292,652 | B2 * | 10/2012 | Rohde | H01R 13/6272 439/352 |
| 8,678,846 | B2 | 3/2014 | Hitchcock et al. | |
| 8,747,146 | B2 * | 6/2014 | Brown | H01R 13/639 439/489 |
| 8,920,187 | B2 * | 12/2014 | Kon | H01R 13/6272 439/352 |
| 9,281,619 | B2 | 3/2016 | Morello et al. | |
| 9,608,373 | B2 * | 3/2017 | Wu | H01R 13/639 |
| 9,680,256 | B1 * | 6/2017 | Lane | H01R 13/6275 |

* cited by examiner

ELECTRICAL CONNECTOR HAVING A CONNECTOR POSITION ASSURANCE ELEMENT

CROSS REFERENCE TO RELATED APPLICATIONS

This application is a continuation-in-part application of U.S. application Ser. No. 15/073,149 filed Mar. 17, 2016 titled CONNECTOR SYSTEM WITH CONNECTOR POSITION ASSURANCE, the subject matter of which is herein incorporated by reference in its entirety.

BACKGROUND OF THE INVENTION

The subject matter herein relates generally to electrical connectors that provide connector position assurance.

In some connector systems, a coupling mechanism is used when a first connector is mated to a second connector to secure the first and second connectors together. The first and second connectors are secured together to ensure that the connector system can withstand forces that would tend to pull the connectors apart and break the conductive pathway that is formed between the connectors when mated to each other. In some embodiments, the coupling mechanism is defined by a latch on one connector that engages a catch of a mating connector when the two connectors are fully mated.

One problem with connector systems is that connectors may unintentionally uncouple or un-mate, causing operating errors due to breaking the conductive signal path between the connectors. The connectors may become un-mated due to, for example, the connectors never achieving a fully mated connection during assembly, such that the latch of the one connector does not properly engage the catch of the other connector. Another potential cause for the unintentional un-mating of the connectors is the latch releasing from the catch after the two connectors have been fully mated which allows the connectors to un-mate. The latch may release from the catch due to a force exerted on the latch from an external object.

The connector system may be used in a complex manufactured product, such as an automobile. If two connectors in a connector system become un-mated from each other during or after assembly of the automobile, an error caused by the break in the conductive pathway may be difficult to discover and/or remedy. For example, it may be difficult to identify and access a faulty connection between two connectors in the automobile that includes numerous connections.

Due to physical characteristics such as small size and shielded conductors, it may be difficult for a worker (or even a machine) to accurately recognize whether two mating connectors are fully mated together at an assembly facility. For example, two connectors that are not fully mated to each other may be less than a millimeter (or a few millimeters) off from the fully mated positions of the connectors, which may be difficult for the worker and/or the machine to identify. A need remains for a connector system that provides assurance that two connectors are fully mated to each other and will not unintentionally un-mate from each other in order to avoid errors caused by breaks in the conductive pathway defined by the connectors.

BRIEF DESCRIPTION OF THE INVENTION

In an embodiment, an electrical connector is provided including a housing having a front end and defining a cavity at the front end that is configured to receive a mating connector therein and having an upper wall above the cavity and a first protrusion extending above the upper wall. The electrical connector includes a connector position assurance (CPA) element slidably coupled to the housing along the upper wall between an extended position and an inserted position. The CPA element, in the inserted position, is disposed more proximate to the front end of the housing than when the CPA element is in the extended position. The CPA element includes a base, a raised section extending from a rear end of the base for actuation of the CPA element between the extended position and the inserted position, and a first beam extending from a front end of the base towards the front end of the housing. The first beam has a first arm and a first finger at a front end of the first beam. The first finger has an abutment wall at the front end configured to abut against the first protrusion and a tip configured to be engaged by the mating connector when received in the cavity. The tip is deflected from a blocked position to a released position as the mating connector is loaded into the cavity. The front end engages the protrusion in the blocked position to block movement of the CPA element from the extended position to the inserted position. The tip is deflected outside of the protrusion to the released position where the tip is able to clear past the protrusion to allow the CPA element to be moved from the extended position to the inserted position.

In another embodiment, an electrical connector is provided including a housing having a front end and defining a cavity at the front end that is configured to receive a mating connector therein. The housing has an upper wall above the cavity having a channel therethrough open at the front end configured to receive a tab of the mating connector. The housing has a first protrusion extending above the upper wall on a first side of the channel and a second protrusion extending above the upper wall on a second side of the channel. The housing has a deflectable latch above the upper wall configured to engage the tab of the mating connector when the mating connector is fully mated to the electrical connector. The electrical connector includes a connector position assurance (CPA) element slidably coupled to the housing along the upper wall between an extended position and an inserted position. The CPA element, in the inserted position, is disposed more proximate to the front end of the housing than when the CPA element is in the extended position. The CPA element includes a base, an raised section extending from a rear end of the base for actuation of the CPA element between the extended position and the inserted position, a first beam extending from a front end of the base towards the front end of the housing, and a second beam extending from a front end of the base towards the front end of the housing and separated from the first beam by a gap aligned above the channel in the upper wall. The gap is configured to receive the tab. The first beam has a first arm and a first finger at a front end of the first beam. The first finger has an abutment wall at the front end configured to abut against the first protrusion and a tip configured to be engaged by the tab and being deflected outward away from the gap from a blocked position to a released position as the mating connector is loaded into the cavity. The front end of the first finger engages the protrusion in the blocked position to block movement of the CPA element from the extended position to the inserted position. The tip is deflected outside of the first protrusion to the released position where the tip is able to clear past the first protrusion to allow the CPA element to be moved from the extended position to the inserted position. The second beam has a second arm and a second finger at a front end of the second beam. The second finger has an abutment wall at the front end configured to abut against the second protrusion. The second finger has a tip configured to be engaged by the tab and being deflected outward away from the gap from a blocked position to a released position as the mating connector is loaded into the cavity. The front end of the second finger engages the protrusion in the blocked position to block movement of the CPA element from the extended position to the inserted position. The tip is deflected outside of the second protrusion to the released position where the tip is able to clear past the second protrusion to allow the CPA element to be moved from the extended position to the inserted position.

DETAILED DESCRIPTION OF THE INVENTION

Figure 1:
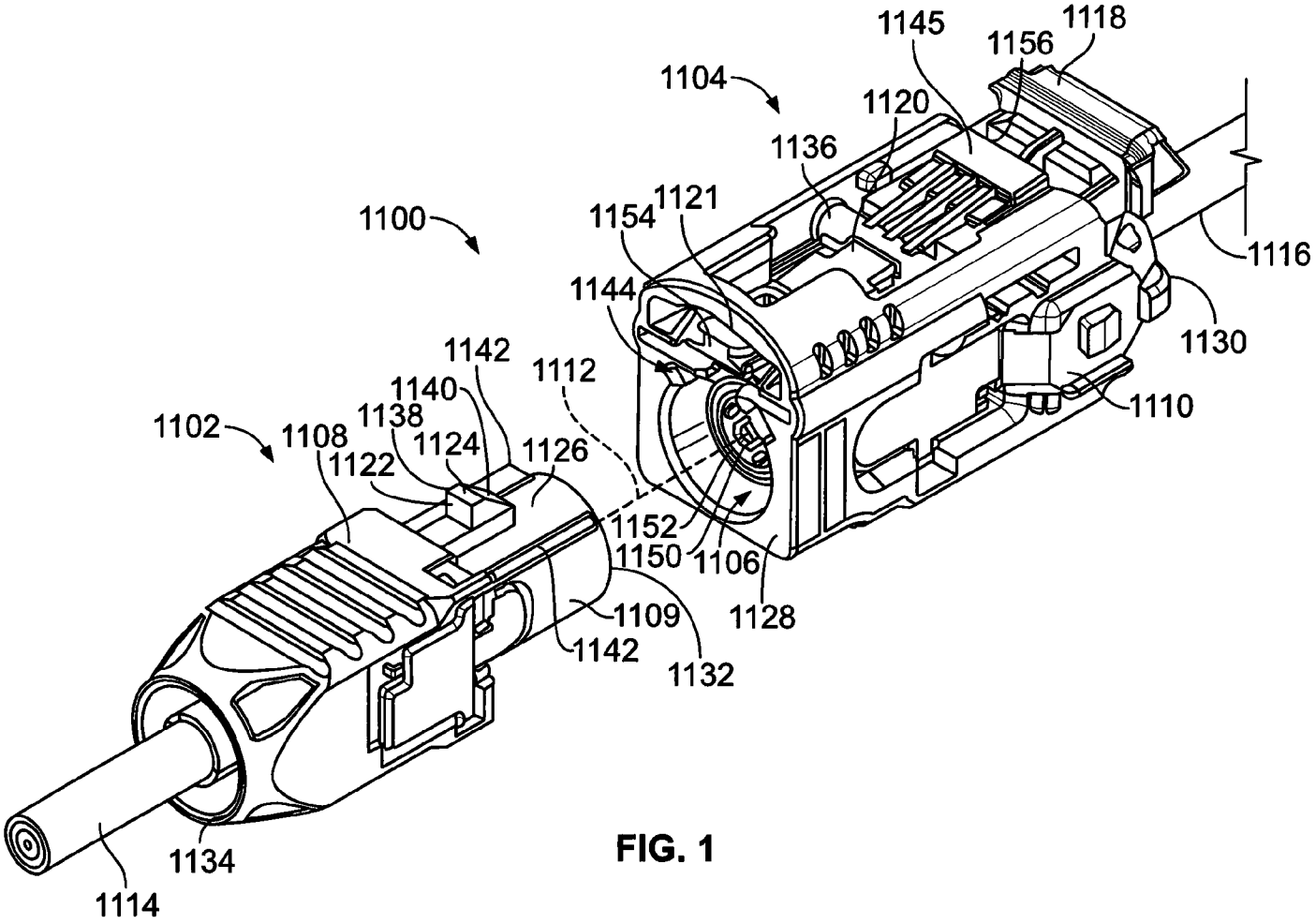
FIG. 1 is a perspective view of a connector system formed in accordance with an embodiment.

One or more embodiments described herein provide a connector system having an electrical connector that includes a connector position assurance (CPA) element. The CPA element is movable between an extended position and an inserted position. For example, the CPA element can be moved back and forth between the extended position and the inserted position. In the inserted position, the CPA element may be more proximate to a front, mating end of the electrical connector than when the CPA element is in the extended position. In embodiments described herein, the CPA element is configured to only be movable from the extended position to the inserted position in response to the mating electrical connector attaining a fully mated position relative to the housing of the electrical connector. Thus, the CPA element is restricted from moving to the inserted position until the mating electrical connector is fully mated with the electrical connector. Once the mating connector is in a fully mated position relative to the housing of the electrical connector, the CPA element is unrestricted or allowed to move to the inserted position. The CPA element may be moved by a human operator or a robotic machine that pushes or pulls the CPA element in the direction towards the inserted position. The CPA element is a connector position assurance mechanism that is used to verify that the electrical connectors are fully mated to each other by providing sensory (for example, tactile, visual, audible, etc.) feedback to an operator or a robotic machine assembling the connector system. Thus, when an operator sees, feels, and/or hears the CPA element moving to the inserted position after a mating connector is loaded into the housing of the electrical connector, the operator is provided assurance that the mating connector is fully loaded relative to the electrical connector.

In an embodiment, the CPA element also provides a secondary locking mechanism that supports a coupling mechanism that couples the mating connector to the electrical connector. For example, the electrical connector may include a latch that pivots about a fulcrum. The latch includes a latching surface on one side of the fulcrum that is configured to engage a catch of the mating connector when the mating connector is fully loaded to retain the connectors in a mated and/or coupled state. When the CPA element is moved to the inserted position (which only occurs when the connectors are mated), the positioning of the CPA element may restrict and/or prevent pivoting of the latch that would move the latching surface out of engagement with the catch of the mating connector. Thus, when the CPA element is in the inserted position, the CPA element supports the coupling mechanism, preventing, or at least prohibiting, the ability of the mating connector to be un-mated or uncoupled from the electrical connector. In an embodiment, the CPA element is configured to be moved from the inserted position to the extended position to allow the latch to disconnect from the catch of the mating connector for un-mating the connectors.

FIG. 1 is a perspective view of a connector system 1100 formed in accordance with an embodiment. The connector system 1100 includes a first electrical connector 1102 and a second electrical connector 1104. In the illustrated embodiment, the first electrical connector 1102 is a male connector, and the second electrical connector 1104 is a female connector, such that a portion of the first electrical connector 1102 is received within a cavity 1106 of the second electrical connector 1104 during a mating operation. More specifically, a portion of a male housing 1108 (e.g., a nose cone) of the first connector 1102 is received within the cavity 1106 defined by a female housing 1110 of the second connector 1104. Although shown as un-mated in FIG. 1, the first and second connectors 1102, 1104 are poised for mating along a mating axis 1112. As used herein, the first electrical connector 1102 is referred to as male connector 1102 or mating connector 1102, and the second electrical connector 1104 is referred to as female connector 1104 or simply as connector 1104.

The connector system 1100 may be used in numerous applications across various industries, such as the automotive industry, the home appliance industry, the aviation industry, and the like, to electrically couple two or more devices and/or electrical components. For example, in the automotive industry, the electrical connectors 1102, 1104 may be used for radio frequency communications, such as to electrically connect an antenna to a controller and/or processing device.

The male connector 1102 and the female connector 1104 each electrically connect to different electrical components and provide a conductive pathway between the corresponding electrical components. In the illustrated embodiment, the male connector 1102 and the female connector 1104 are electrically connected to corresponding conductive cables or wires 1114, 1116, such as coaxial cables. In an alternative embodiment, the male connector 1102 and/or the female connector 1104 may be mounted (e.g., edge-mounted) to a corresponding circuit board. The cable 1114 is electrically terminated (e.g., crimped, soldered, etc.) to electrical contacts (not shown) of the male connector 1102. The cable 1116 is electrically terminated to electrical contacts (for example, a center contact 1150 and an outer contact 1152) of the female connector 1104. The electrical contacts of the male connector 1102 engage the electrical contacts 1150, 1152 of the female connector 1104 when the connectors 1102, 1104 are mated. Various electrical signals conveying power, control messages, data, or the like, may be transmitted through the connectors 1102, 1104 between the cable 1114 and the cable 1116.

The male connector 1102 and the female connector 1104 both have in-line shapes in the illustrated embodiment. For example, the mating axis 1112 along which the male connector 1102 is loaded into the cavity 1106 is generally parallel to the orientation of the cable 1114 exiting the male connector 1102 and the cable 1116 exiting the female connector 1104. In an alternative embodiment, the male connector 1102 and/or the female connector 1104 may have a right angle or other angle shape.

The female housing 1110 of the female connector 1104 extends between a front end 1128 and a rear end 1130. The front end 1128 is a mating end that faces the male connector 1102. The cavity 1106 extends at least partially through the female housing 1110 between the front end 1128 and the rear end 1130. The cavity 1106 is open at the front end 1128. The female connector 1104 includes a CPA element 1118 that is mounted on the female housing 1110. The CPA element 1118 is disposed outward of the cavity 1106, as opposed to being located within or in-line with the cavity 1106. In the illustrated orientation of the female connector 1104, the CPA element 1118 is disposed above the cavity 1106. The CPA element 1118 is moveable between an extended position and an inserted position relative to the female housing 1110. The CPA element 1118 is in the extended position in FIG. 1. The CPA element 1118 is configured to move linearly in an actuation path between the extended and inserted positions. The actuation path of the CPA element 1118 in an embodiment is parallel to the mating axis 1112. In the inserted position, the CPA element 1118 is more proximate to the front end 1128 of the female housing 1110 than when the CPA element 1118 is in the extended position. The CPA element 1118 provides connector position assurance that indicates if the male connector 1102 and the female connector 1104 are properly mated to one another because the CPA element 1118 is configured to only be moveable from the extended position to the inserted position when the male connector 1102 is in (or is substantially close to) a fully mated position relative to the female connector 1104. As used herein, the fully mated position of the male connector 1102 refers to a proper mating position in which the male connector 1102 is properly electrically connected to the female connector 1104 and the coupling mechanism is locked in order to retain the male and female connectors 1102, 1104 in the coupled state. Thus, if the male connector 1102 is not fully loaded within the cavity 1106 of the female connector 1104, then the CPA element 1118 is blocked from being moved from the extended position to the inserted position.

The female housing 1110 includes a coupling lever or latch 1120. The latch 1120 is mounted to the housing 1110 and is pivotable relative to the housing 1110 about a fulcrum 1136. The latch 1120 defines the coupling mechanism of the female connector 1104 for selectively locking the female connector 1104 to the male connector 1102. For example, the latch 1120 includes a latching surface 1121 that is configured to engage a catch 1122 of the male connector 1102 to secure the female housing 1110 to the male housing 1108. The engagement between the latching surface 1121 and the catch 1122 is designed to absorb and withstand forces incidental to normal use that pull the connectors 1102, 1104 apart. The latch 1120 is configured to pivot radially outward relative to the cavity 1106. The latch 1120 may pivot responsive to engagement with the male housing 1108 as the male connector 1102 is loaded into the cavity 1106, which lifts a first or latching end 1154 of the latch 1120 proximate to the latching surface 1121. Additionally, or alternatively, the latch 1120 may pivot due to depression of a button segment 1145 of the latch 1120, as described in more detail below. The button segment 1145 is disposed proximate to an opposite, second end 1156 of the latch 1120, and the fulcrum 1136 is disposed between the latching surface 1121 and the button segment 1145.

The male housing 1108 extends between a mating end 1132 and a back end 1134. The male housing 1108 is loaded in the cavity 1106 such that the mating end 1132 is received in the cavity 1106, while the back end 1134 does not enter the cavity 1106. In the illustrated embodiment, the male housing 1108 includes a nose cone 1109 that has a generally cylindrical shape. The nose cone 1109 includes a tab 1124 that projects from an outer surface 1126 of the nose cone 1109. The tab 1124 is configured to engage the latch 1120. The tab 1124 defines the catch 1122. The catch 1122 is a rear surface of the tab 1124 that faces the back end 1134 of the housing 1108. The tab 1124 may pivot the latch 1120 as the male connector 1102 is loaded. For example, a top side 1138 of the tab 1124 may define a ramp 1140 that engages and gradually increases the pivoting of the latch 1120 as the male connector 1102 moves along the mating axis 1112 towards the fully loaded position. In the fully loaded position, the catch 1122 of the tab 1124 engages the latching surface 1121 of the female housing 1110 to secure the male connector 1102 to the female connector 1104. The nose cone 1109 optionally may include at least one keying ridge 1142 that projects from the outer surface 1126. Each keying ridge 1142 is configured to be received in a corresponding key groove 1144 along a periphery of the cavity 1106 to ensure that the nose cone 1109 properly aligns with the female housing 1110 during mating.

Optionally, the male and female connectors 1102, 1104 in the connector system 1100 may be standardized connectors, such as FAKRA standardized connectors. FAKRA is the Automotive Standards Committee in the German Institute for Standardization, representing international standardization interests in the automotive field. The FAKRA standard provides a system, based on keying and color coding, for proper connector attachment. For example, the keying ridges 1142 of the male housing 1108 and the key grooves 1144 on the female housing 1110 may be features designed according to desired FAKRA specifications for restricting the mateability of each of the connectors 1102, 1104 to one or more specific mating connectors.

Figure 2:
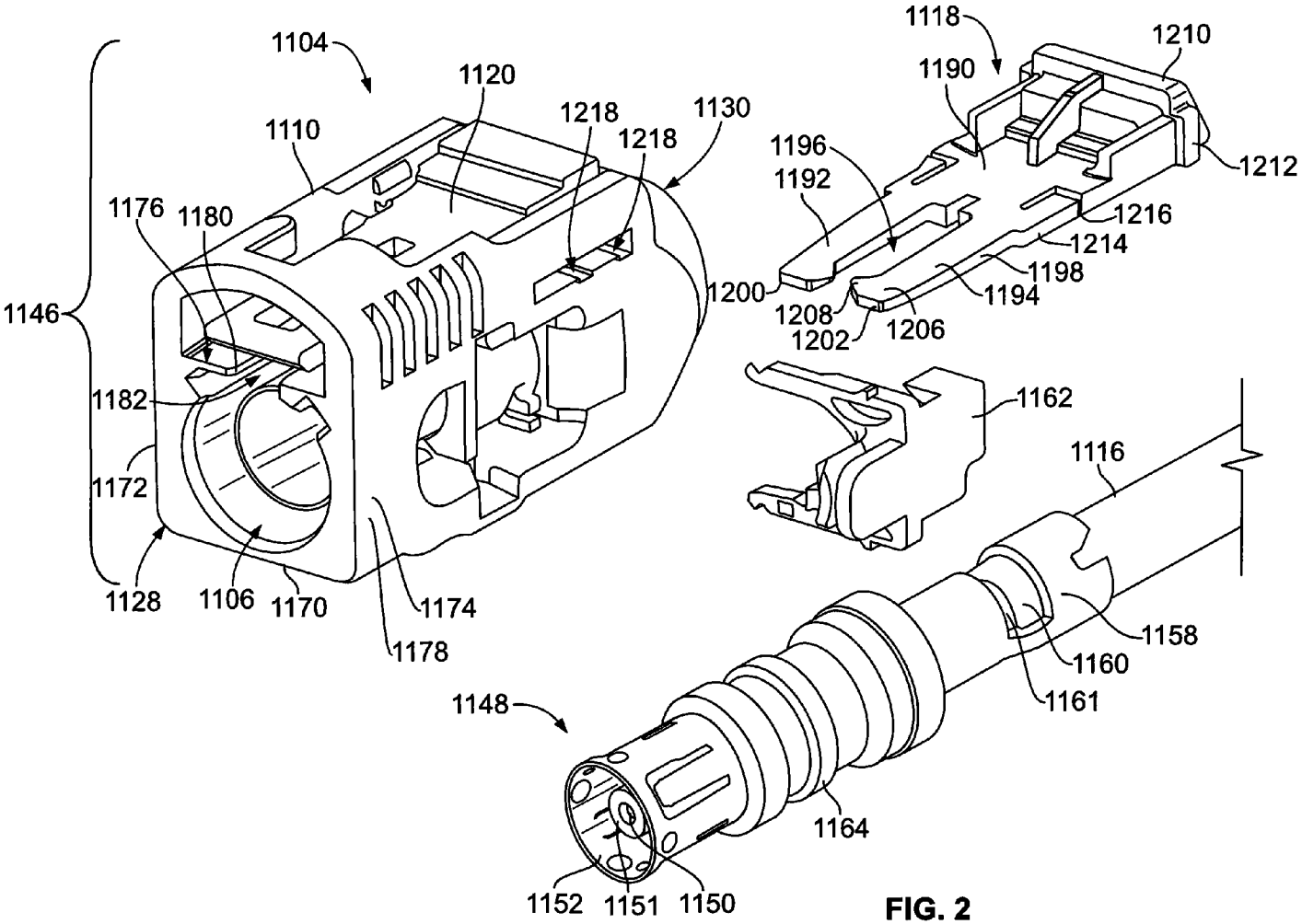
FIG. 2 is a partially exploded view of an electrical connector of the connector system according to an embodiment.

FIG. 2 is a partially exploded view of the female connector 1104 according to an embodiment. The female connector 1104 includes a housing assembly 1146 and a contact assembly 1148. In the illustrated embodiment, the housing assembly 1146 is exploded, and the contact assembly 1148 is intact. The housing assembly 1146 includes the female housing 1110, the CPA element 1118, and a retainer clip 1162. The retainer clip 1162 is optional. In the illustrated embodiment, the housing 1110 is a single, unitary component. In an alternative embodiment, the housing 1110 may be an assembly of multiple discrete members, such as an upper housing member that includes the latch 1120 and a lower housing member that defines the cavity 1106.

The contact assembly 1148 may be a coaxial contact assembly including the center contact 1150, a dielectric 1151 surrounding the center contact 1150, and the outer contact 1152 surrounding the dielectric 1151. The dielectric 1151 provides electrical insulation between the center contact 1150 and the outer contact 1152. The contact assembly 1148 is terminated to the cable 1116 by a ferrule 1158 that is crimped around an outer jacket 1160 of the cable 1116. The ferrule 1158 may also be crimped around a cable braid 1161 of the cable 1116. The contact assembly 1148 also includes a cavity insert 1164 that surrounds the outer contact 1152. The cavity insert 1164 is composed of a dielectric material to provide electrical insulation for the outer contact 1152. The cavity insert 1164 is also configured to interface with the housing 1110 inside of the cavity 1106 to secure the contact assembly 1148 in position relative to the housing 1110. The retainer clip 1162 is configured to be loaded in the housing 1110 to secure the contact assembly 1148 to the housing 1110.

The female housing 1110 includes the latch 1120 and a body 1178 that defines the cavity 1106. The body 1178 includes a bottom wall 1170, a first side wall 1172, and an opposite second side wall 1174. An upper wall 1176 of the housing 1110, opposite the bottom wall 1170, is at least partially open. As used herein, relative or spatial terms such as "top," "bottom," "front," "rear," "first," and "second" are only used to distinguish the referenced elements of the female connector 1104 and do not require particular positions or orientations relative to the direction of gravity and/or relative to the surrounding environment of the female connector 1104, including the male connector 1102 (shown in FIG. 1). The bottom wall 1170, first side wall 1172, and second side wall 1174 all define respective portions of the cavity 1106. The upper wall 1176 defines a platform 1180 that at least partially defines the cavity 1106. The upper wall 1176 defines a channel 1182 that extends therethrough. The channel 1182 is open at the front end 1128 of the housing 1110 and extends longitudinally rearward from the front end 1128. The channel 1182 is configured to accommodate the tab 1124 (shown in FIG. 1) of the male housing 1108 (FIG. 1).

The CPA element 1118 includes a base 1190 and first and second beams 1192, 1194 that extend forward from the base 1190. The base 1190 may be generally planar. Although two beams 1192, 1194 are shown in the illustrated embodiment, the CPA element 1118 may include only one beam or more than two beams in other embodiments. The CPA element 1118 includes a raised section 1210 at a rear end 1212 of the base 1190 and an intermediate section between the rear end 1212 and a front end 1213 of the base 1190. The raised section 1210 defines an actuator that is used to push or pull the CPA element 1118 between the extended and inserted positions. The raised section 1210 includes one or more gripping surfaces, such as a fingernail slot, that provides a place of contact for an operator to grip or otherwise engage the CPA element 1118 in order to move the CPA element 1118 between the extended and inserted positions.

The first and second beams 1192, 1194 extend generally parallel to one another and in a same general direction from the base 1190. The first and second beams 1192, 1194 may be generally coplanar with each other and with the base 1190. The beams 1192, 1194 are spaced apart from each other to define a lateral gap 1196 therebetween. The beams 1192, 1194 may be similar to each other and like components may be referred to using like reference numerals. Components may be described herein with reference to the first beam 1192 and/or the second beam 1194 individually or collectively. Components may be, but not necessarily, referred to hereinafter using a "first" or a "second" designation corresponding to the first beam 1192 or the second beam 1194, respectively.

The first and second beams 1192, 1194 may have identical or at least similar shapes that mirror one another. For example, the beams 1192, 1194 each include an arm 1198 that extends from the base 1190 to a front or distal end 1200 of the respective beam 1192, 1194. The first and second arms 1198 may be generally planar. For example, each arm 1198 may include two opposite planar broad sides and two edge sides that extend between the broad sides. The beams 1192, 1194 are configured to deflect along a plane that is parallel to the planar broad sides. In an exemplary embodiment, the distal end 1200 may be a vertical wall defining an abutment wall 1202 at the distal end 1200 used to block forward movement of the CPA element 1118 relative to the housing 1110, as described in further detail below. The abutment wall 1202 may be a solid wall between the opposite edge sides and broad sides of the arm 1198, such as devoid of openings or slots.

In an embodiment, at least a portion of both beams 1192, 1194 extends towards the other beam 1192, 1194. For example, in the illustrated embodiment, each beam 1192, 1194 includes a finger 1206 that projects inward from the interior edge of the respective arm 1198. The fingers 1206 of the beams 1192, 1194 may be located proximate to the distal ends 1200. The fingers 1206 may be protrusions of various sizes and/or shapes. For example, the fingers 1206 may be bumps, barbs, lips, ledges, detents, or the like, having curved or linear surfaces. In an exemplary embodiment, the fingers 1206 have tips 1208 at inner edges of the fingers 1206 that face the gap 1196. The fingers 1206 may be tapered with the tips 1208 being narrower than the root or base of the finger 1206 at the arm 1198. The finger 1206 of the first beam 1192 extends towards the finger 1206 of the second beam 1194 across the gap 1196. As such, a width of the gap 1196 between the first and second beams 1192, 1194 is reduced between the fingers 1206 relative to the width of the gap 1196 between the arms 1198 at a spaced apart location from the fingers 1206.

In an embodiment, the CPA element 1118 also includes retention latches 1214 that are cantilevered from and extend below the base 1190. The retention latches 1214 are provided at both sides of the base 1190. The retention latches 1214 have distal ends 1216 that are configured to be received in grooves or detents 1218 in the upper wall 1176 of the housing 1110. The retention latches 1214 are configured to be received in the different detents 1218 at the different extended and inserted positions.

During assembly, the contact assembly 1148 is loaded into the cavity 1106, such as through the rear end 1130. The retainer clip 1162 is loaded into the housing 1110 to retain the contact assembly 1148 in the housing 1110. The CPA element 1118 is coupled to the top end of the housing 1110 along the platform 1180, such as under the latch 1120.

Figure 3:
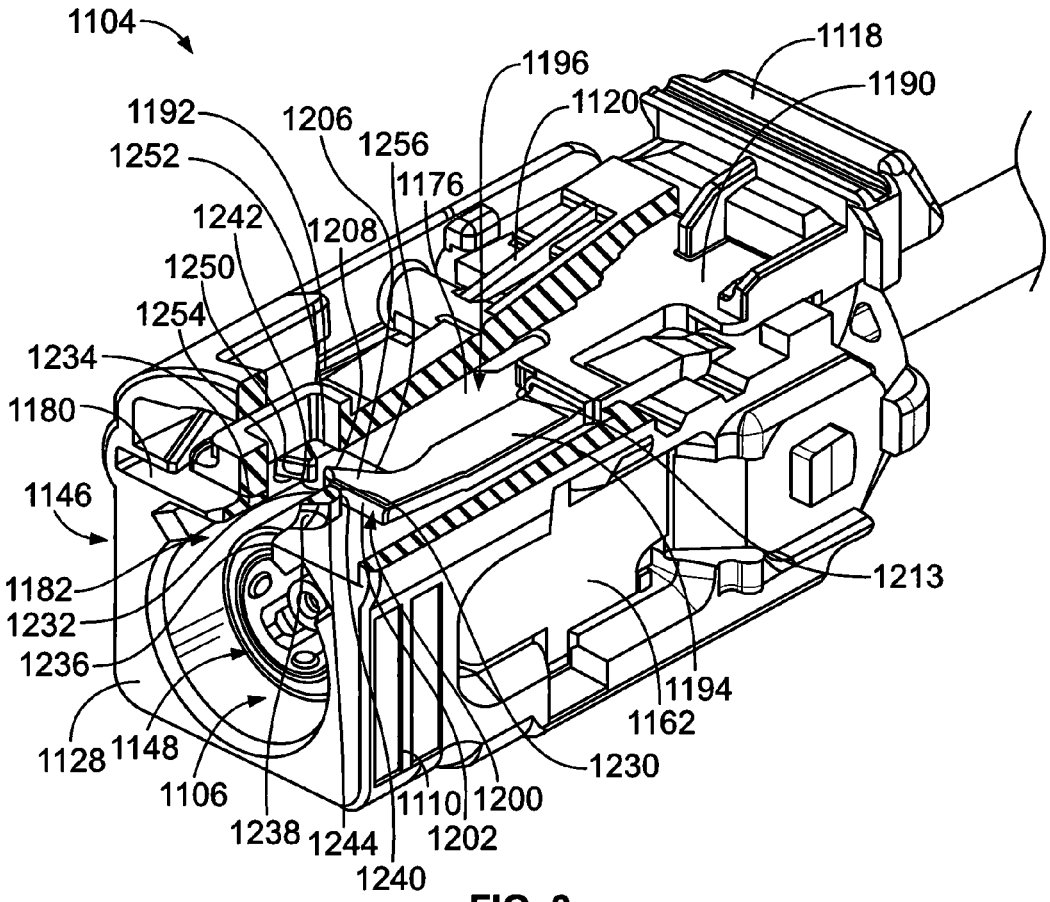
FIG. 3 is a top perspective, partial sectional view of the electrical connector in an assembled state according to an embodiment.
Figure 4:
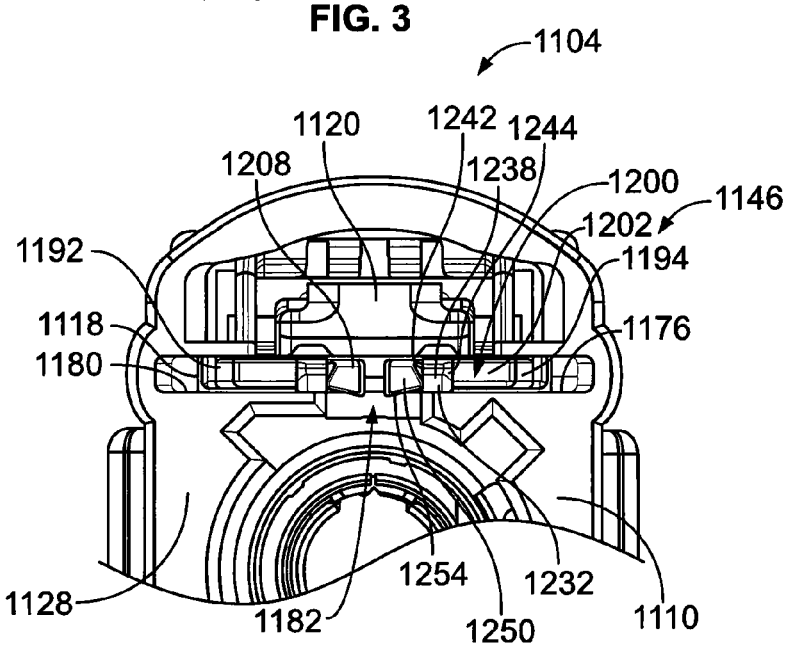
FIG. 4 is a front view of a portion of the electrical connector.

FIG. 3 is a top perspective, partial sectional view of the female connector 1104 in an assembled state according to an embodiment. FIG. 4 is a front view of a portion of the female connector 1104. The contact assembly 1148 is loaded within the cavity 1106 of the housing assembly 1146. The CPA element 1118 and the retainer clip 1162 are both mounted to the housing 1110. The CPA element 1118 is located in the extended position in the illustrated embodiment.

The CPA element 1118 is configured to be moved relative to the housing 1110 to the inserted position responsive to the male connector 1102 (shown in FIG. 1) being fully loaded in the cavity 1106 of the female housing 1110. The CPA element 1118 is configured to move linearly along an actuation path that is parallel to a mating axis. The first and second beams 1192, 1194 extend forward from a front end 1213 of the base 1190 towards the front end 1128.

In an embodiment, the CPA element 1118 is disposed between the latch 1120 and the upper wall 1176. For example, the bottom side of the CPA element 1118 engages the platform 1180 and slides along the platform 1180 along the actuation path. The beams 1192, 1194 of the CPA element 1118 may engage the platform 1180 in both the extended position and the inserted position of the CPA element 1118. In an exemplary embodiment, the beams 1192, 1194 are pre-loaded against the platform 1180 to ensure that the beams 1192, 1194 remain pressed downward against the platform 1180, such as when the beams 1192, 1194 are being deflected by the tab 1124 of the male connector 1102. In various embodiments, the beams 1192, 1194 are twisted or rotated inward toward each other to pre-load the beams 1192, 1194 against the upper wall 1176. The pre-load of the beams 1192, 1194 creates an internal biasing or pre-load force to hold the tips 1208 of the beams 1192, 1194 downward. The pre-load force holds the beams 1192, 1194 against the tab 1124 as the tab 1124 is loaded between the beams 1192, 1194, such as to resist the beams 1192, 1194 from lifting off of the platform 1180 as the beams 1192, 1194 are deflected by the tab 1124. The first beam 1192 extends along the platform 1180 on one side (for example, to the left) of the channel 1182, and the second beam 1194 extends along the platform 1180 on an opposite side (for example, to the right) of the channel 1182.

The beams 1192, 1194 are deflectable between a blocked position of the beams 1192, 1194 and a clearance position of the beams 1192, 1194. For example, when the CPA element 1118 is in the extended position and the beams 1192, 1194 are in the blocked position, one or both of the beams 1192, 1194 is configured to abut a corresponding protrusion or protrusion 1232 extending from the upper wall 1176 of the housing 1110. The abutment walls 1202 at the distal ends 1200 of the beams 1192, 1194 abut against hard stop surfaces 1230 of the protrusions 1232, such as defined by the rear facing surfaces of the protrusions 1232. The protrusions 1232 mechanically block the CPA element 1118 from moving from the extended position to the inserted position. Thus, the protrusions 1232 are in the path of the corresponding beams 1192, 1194 and blocks forward movement of the CPA element 1118 from the extended position. The beams 1192, 1194 are deflectable from the blocked position to the clearance position, such as by the tab 1124 of the male connector 1102. In the clearance position, the beams 1192, 1194 are able to clear and move past the protrusions 1232.

In the blocked position, the abutment walls 1202 at the distal ends 1200 of the beams 1192, 1194, such as at the fingers 1206, abut against the protrusions 1232 and the protrusions 1232 block the CPA element 1118 from moving forward. In an embodiment, the protrusions 1232 extend upward from the platform 1180 on opposite sides 1234, 1236 of the channel 1182. In an exemplary embodiment, the protrusions 1232 have an oblong and complex shape; however, the protrusions 1232 may have a uniform shape in alternative embodiments, such as a cylindrical shape. Each protrusion 1232 has a front edge 1238, a rear edge 1240, an inner edge 1242 and an outer edge 1244. The rear edge 1240 defines the hard stop surface 1230. The inner edge 1242 faces the channel 1182. The outer edge 1244 generally faces away from the channel 1182. In the illustrated embodiment, the front and rear edges 1238, 1240 are curved. The inner edge 1242 is generally planar and vertical and may be aligned with the channel 1182. The outer edge 1244 may have a planar section and intermediate sections that transition to the front and rear edges 1238, 1240. Optionally, the edges 1238, 1240, 1242, 1244 are shaped to facilitate movement of the finger 1206 along the protrusion 1232 as the CPA element 1118 is transferred between the extended and installed positions. For example, the edges 1238, 1240, 1242, 1244 are curved or angled to promote ease of transfer of the tip 1208 along the surface of the protrusion 1232 when the beam 1192, 1194 is forced outward by the tab 1124 to reduce stubbing or damage from exerting too much pressure on the beam 1192, 1194 during transfer. The protrusion 1232 may have other shapes in alternative embodiments having other surfaces or edges. For example, the protrusions 1232 may have other shapes and sizes, such as a cuboid, a barb, a bump, or the like, that includes a hard stop surface that blocks movement of the CPA element 1118 to the inserted position when the beams 1192, 1194 are in the blocked position.

In an embodiment, the beams 1192, 1194 are configured to be engaged by the male connector 1102 (shown in FIG. 1) as the male connector 1102 is loaded into the cavity 1106. For example, the tab 1124 (shown in FIG. 1) is configured to engage the fingers 1206 of the beams 1192, 1194 to deflect the beams 1192, 1194. The male connector 1102 deflects the beams 1192, 1194 from the blocked position to a clearance position. In an embodiment, the beams 1192, 1194 may be at a resting or unbiased state in the blocked position, and the male connector 1102 forces the beams 1192, 1194 to a biased, defected state to reach the clearance position. In the clearance position, the beams 1192, 1194 clear the hard stop surfaces of the protrusions 1232, which allows the CPA element 1118 to be moved from the extended position to the inserted position. The male connector 1102 deflects the beams 1192, 1194 to the clearance position responsive to the male connector 1102 reaching the fully mated position relative to the female connector 1104. The beams 1192, 1194 do not achieve the clearance position until the male connector 1102 is fully mated to the female connector 1104, so the CPA element 1118 is not able to be moved to the inserted position until the male and female connectors 1102, 1104 are fully mated.

The tip 1208 of the finger 1206 includes a front edge 1250, a rear edge 1252 and a bottom edge 1254. The front edge 1250 is configured to engage the mating connector 1102 as the mating connector 1102 is loaded into the cavity 1106. For example, the front edge 1250 is configured to engage the tab 1124 of the mating connector 1102. The front edge 1250 of the tip 1208 is undercut relative to the distal end 1200 of the finger 1206 such that the front edge 1250 is non planar with the distal end 1200 and non-parallel to the distal end 1200. In the illustrated embodiment, the front edge 1250 faces generally inward and forward and may face generally downward. The bottom edge 1254 is configured to engage the mating connector 1102, such as the tab 1124, as the mating connector 1102 is loaded into the cavity 1106. The bottom edge 1254 is undercut relative to the bottom of the finger 1206 such that the bottom edge 1254 is non-planar with the bottom and non-parallel to the bottom. The bottom edge 1254 may face generally downward and outward away from the gap 1196. The rear edge 1252 is configured to engage the front edge 1238 of the protrusion 1232 when the CPA element 1118 is moved to the inserted position. The rear edge 1240 of the tip 1208 includes a ramp surface 1256. The front edge 1238 of the protrusion 1232 may be angled at a complementary angle to the ramp surface 1256. The ramp surface 1256 may force the arm 1198 outward against the front edge 1238 of the protrusion 1232 when the CPA element 1118 is moved rearward from the inserted position to the extended position. The rear edge 1252 may be undercut such that the rear edge 1252 is non-vertical. For example, the rear edge 1252 may be generally rearward facing and downward facing.

Figure 5:
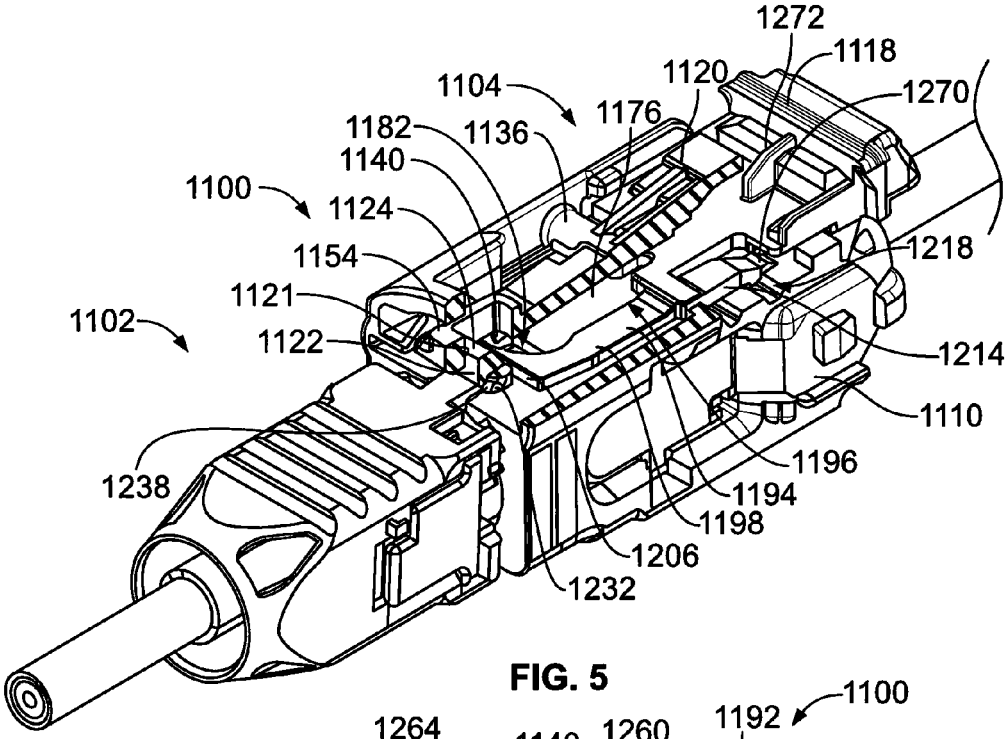
FIG. 5 is a perspective, partial sectional view of the connector system.
Figure 6:
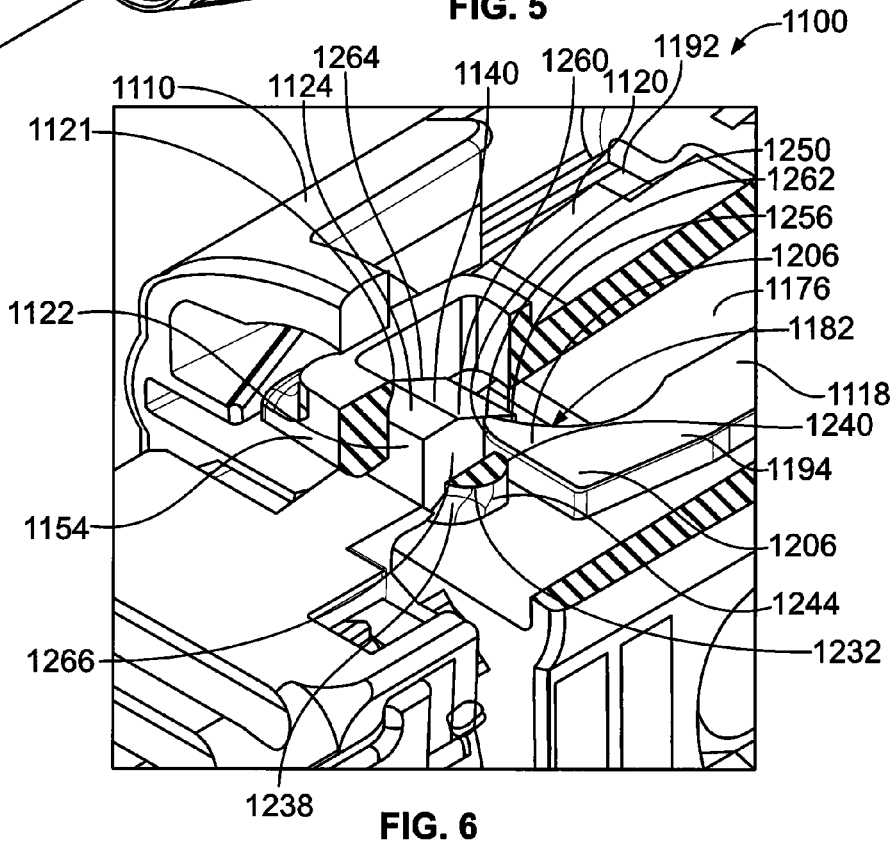
FIG. 6 is an enlarged, partial sectional view of a portion of the connector system in the fully mated state.
Figure 7:
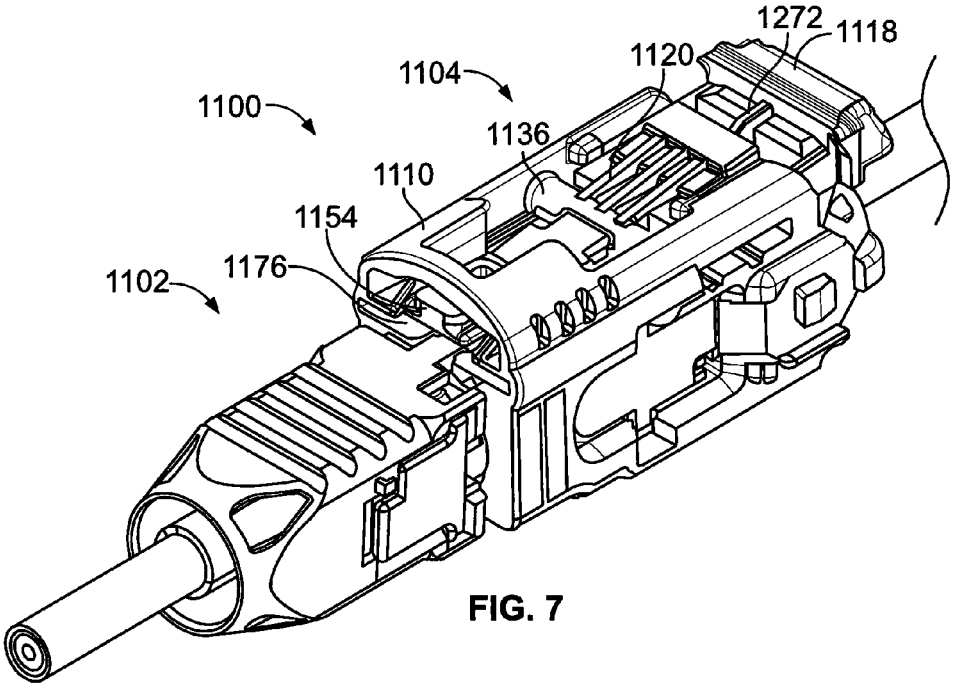
FIG. 7 is a perspective view of the connector system in the fully mated state showing a CPA element in an extended position.
Figure 8:
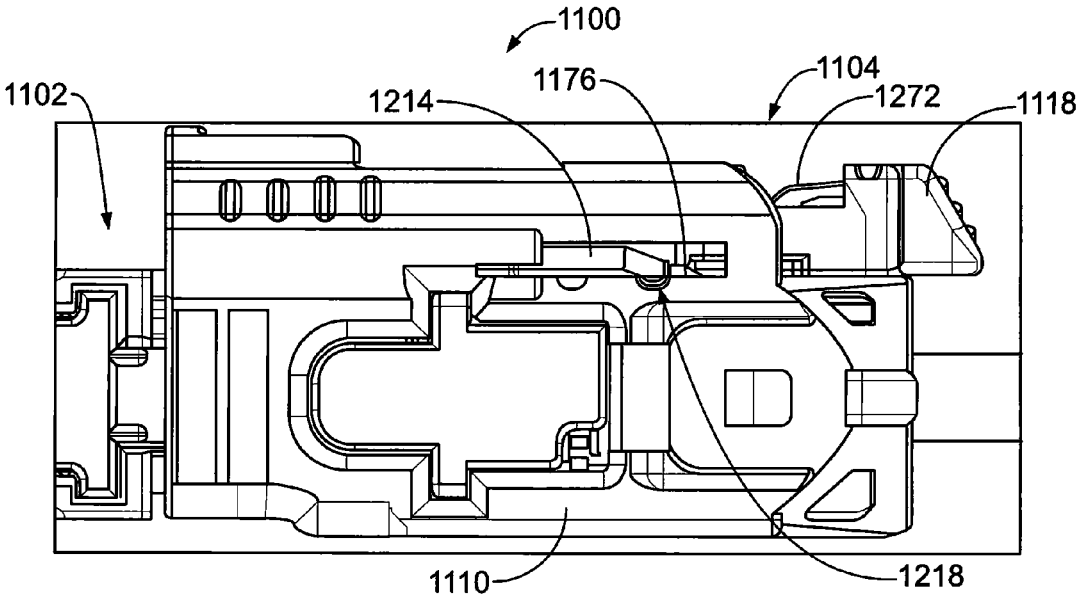
FIG. 8 is a side view of a portion of the connector system in a fully mated state showing the CPA element in an extended position.

FIG. 5 is a perspective, partial sectional view of the connector system 1100 in a fully mated state of the male and female connectors 1102, 1104. FIG. 6 is an enlarged, partial sectional view of a portion of the connector system 1100 in the fully mated state. FIG. 7 is a perspective view of the connector system 1100 in the fully mated state showing the CPA element 1118 in an extended position. FIG. 8 is a side view of a portion of the connector system 1100 in a fully mated state showing the CPA element 1118 in an extended position. FIGS. 5 and 6 illustrate the CPA element in the extended position and the beams 1192, 1194 in the clearance position.

As the male connector 1102 is loaded into the cavity 1106, the tab 1124 may engage the latching end 1154 of the latch 1120. For example, the ramp 1140 of the tab 1124 engages the latching end 1154 and forces the latch 1120 to pivot about the fulcrum 1136 as the ramp 1140 lifts the latching end 1154. Upon reaching the fully mated position, the latching surface 1121 of the latch 1120 is configured to engage the catch 1122 of the tab 1124 to secure the male connector 1102 to the female connector 1104.

In an embodiment, the beams 1192, 1194 of the CPA element 1118 are configured to be engaged and deflected by the tab 1124 (shown in FIG. 1) of the male connector 1102 (FIG. 1). The tab 1124 protrudes through the channel 1182 of the upper wall 1176 and at least partially into the gap 1196 between the beams 1192, 1194. The tab 1124 deflects the beams 1192, 1194 laterally outward relative to the channel 1182 such that the beams 1192, 1194 deflect away from each other. In the illustrated embodiment, the arms 1198 of the beams 1192, 1194 are spaced apart laterally from the channel 1182 and the fingers 1206 extend from the arms 1198 over the channel 1182. As the male connector 1102 is received in the cavity 1106, the tab 1124 protrudes through the channel 1182 and engages the fingers 1206 of the beams 1192, 1194 to deflect the beams 1192, 1194 from the blocked position to the clearance position.

The movement of the male connector 1102 along the mating axis 1112 causes the tab 1124 to extend at least partially into the gap 1196 between the beams 1192, 1194. A front edge 1260 of the tab 1124 defined by the ramp 1140 engages the fingers 1206 of the beams 1192, 1194 and forces the beams 1192, 1194 to deflect outward. In an embodiment, the fingers 1206 of the beams 1192, 1194 have the lead-in front edges 1250 that define ramp surfaces 1256 of the fingers 1206. The front edge 1260 of the tab 1124 engages and slides along the front edges 1250 to gradually increase the amount of deflection of the beams 1192, 1194 without stubbing. Once the male connector 1102 is in the fully mated position, the beams 1192, 1194 attain the clearance position. For example, inner edges 1262 of the tips 1208 of the fingers 1206 clear the front edge 1260 of the tab 1124 and engage sides 1264, 1266 of the tab 1124. As the tab 1124 is held in place by the interaction between the catch 1122 and the latching surface 1121, the tab 1124 holds the beams 1192, 1194 in the clearance position.

In the clearance position, the beams 1192, 1194 are able to bypass the corresponding protrusions 1232 because the tab 1124 holds the beams 1192, 1194 in a deflected state. For example, the tips 1208 of the fingers 1206 may be moved outside of the hard stop surfaces defined by the rear edges 1240 of the protrusions 1232 to allow the fingers 1206 to bypass the protrusions 1232. The tips 1208 of the fingers 1206 may ride along the protrusions 1232 as the CPA element 1118 is slid forward from the extended position to the inserted position. For example, the angled front edges 1250 of the fingers 1206 may engage and ride along the curved or angled rear edges 1240 of the protrusions 1232 to force the inner edges 1262 of the tips 1208 of the fingers 1206 to clear the rear edges 1240 and begin riding along the outer edges 1244 and eventually clear the front edges 1238.

In an embodiment, in the extended position, the retention latches 1214 of the CPA element 1118 are received in the rearward detents 1218 in the upper wall 1176 of the housing 1110. The retention latches 1214 provide some holding force to hold the CPA element 1118 in the extended position. The holding force can be overcome to move the CPA element 1118 to the inserted position once the beams 1192, 1194 clear the protrusions 1232. In an exemplary embodiment, the housing 1110 includes hard stops 1270 rearward of the retention latches 1214 to stop the CPA element 1118 from moving rearward beyond the extended position.

In the extended position, a latch block 1272 of the CPA element 1118 is positioned rearward of the latch 1120. The latch 1120 is able to be pressed downward when the latch block 1272 is in an unblocking position rearward of the latch 1120.

Figure 9:
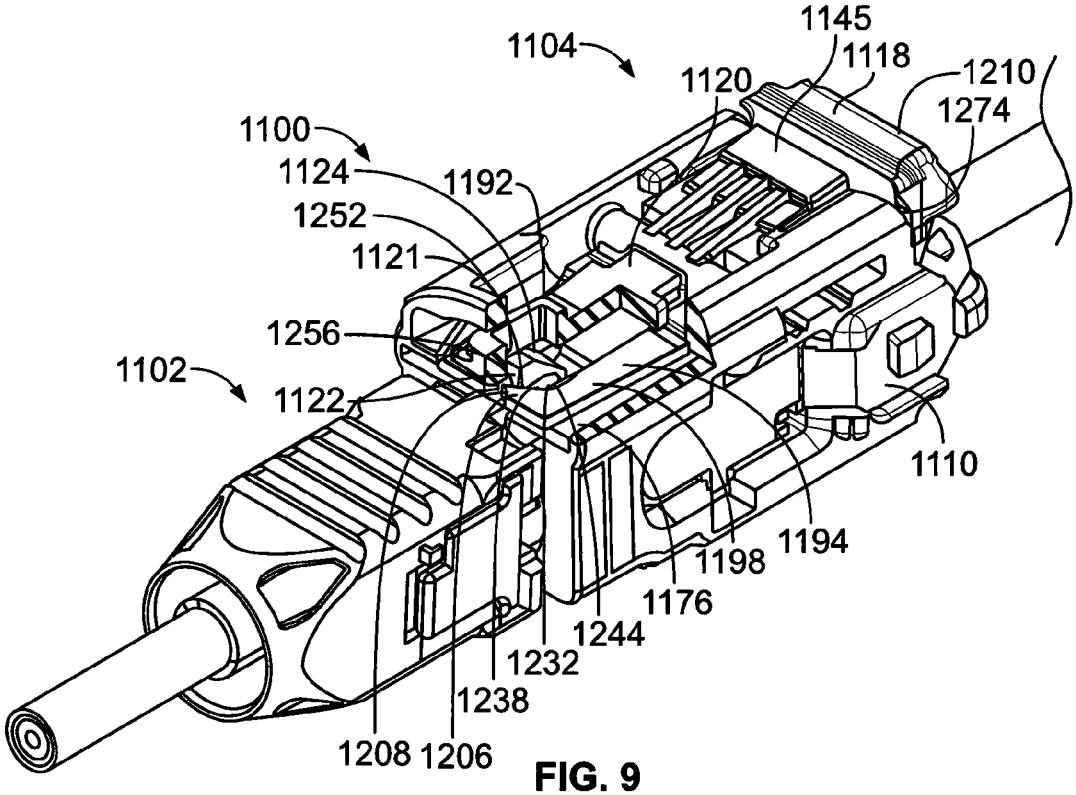
FIG. 9 is a perspective view of the connector system in a fully mated state showing the CPA element in an inserted position.
Figure 10:
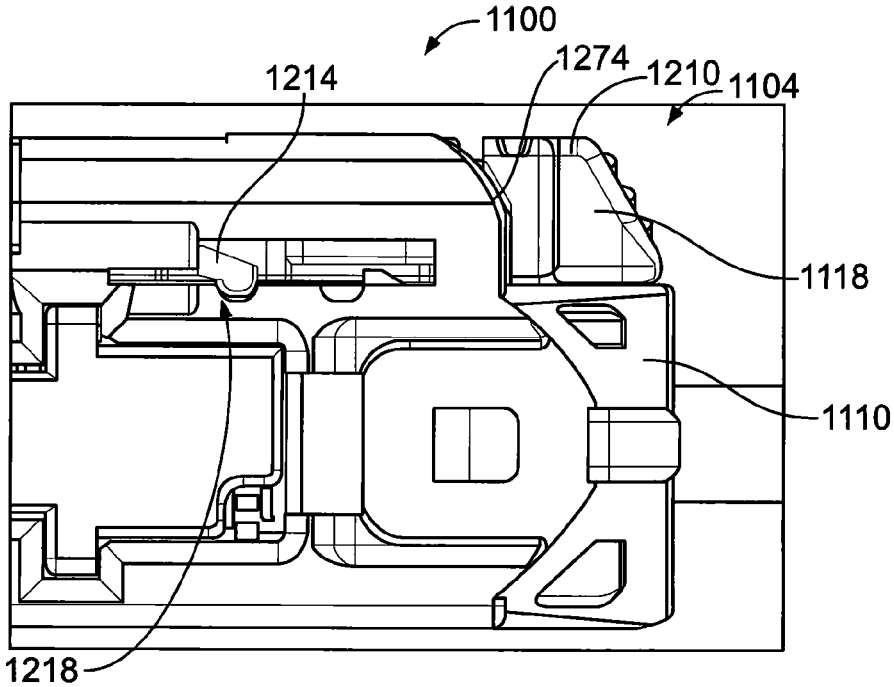
FIG. 10 is a side view of a portion of the connector system in a fully mated state showing the CPA element in the inserted position.

FIG. 9 is a perspective view of the connector system 1100 in a fully mated state of the male and female connectors 1102, 1104 showing the CPA element 1118 in the inserted position. FIG. 10 is a side view of a portion of the connector system 1100 in a fully mated state showing the CPA element 1118 in the inserted position. The CPA element 1118 is able to be moved to the inserted position after the male connector 1102 is fully mated to the female connector 1104, and the beams 1192, 1194 are deflected to the clearance position, as described with reference to FIGS. 5 and 6. As the CPA element 1118 is moved by a human operator or a robot in an insertion direction (e.g., forward) relative to the female housing 1110 and the tab 1124, the fingers 1206 of the beams 1192, 1194 engages and slides along the outer edges 1244 of the protrusions 1232. The beams 1192, 1194 remain in a deflected state as the CPA element 1118 is moved to the inserted position and the beams 1192, 1194 ride along the outer edges 1244. Once the fingers 1206 clear the protrusions 1232 and are forward of the protrusions 1232, the fingers 1206 close back in around the front edges 1238 of the protrusions 1232. As the CPA element 1118 approaches the inserted position, the tips 1208 close around the protrusions 1232 and engage the front edges 1238 of the protrusions 1232.

In the inserted position, the fingers 1206 are forward of the protrusions 1232. The rear edges 1252 of the fingers 1206 engage the front edges 1238 of the protrusions 1232. The rear edges 1252 are forward of the tab 1124 to block the tab 1124. The bias of the beams 1192, 1194 forces the beams

1192, 1194 to resiliently return towards an undeflected state, such that the beams 1192, 1194 move toward each other after the beams 1192, 1194 clear the protrusions 1232. The fingers 1206 provide a soft stop that restricts the CPA element 1118 from unintentionally sliding from the inserted position in an extension direction towards the extended position. The fingers 1206 optionally may also force the tab 1124 rearward to retain the male connector 1102 in the fully mated position and/or to pull the male connector 1102 from a substantially fully mated position to an absolute fully mated position.

In an exemplary embodiment, in the inserted position, the retention latches 1214 of the CPA element 1118 are received in the forward detents 1218 in the upper wall 1176 of the housing 1110. The retention latches 1214 provide some holding force to hold the CPA element 1118 in the inserted position. The holding force can be overcome to move the CPA element 1118 back to the extended position. In an exemplary embodiment, the housing 1110 includes hard stops 1274 forward of the raised section 1210 to stop the CPA element 1118 from moving forward beyond the inserted position.

In the inserted position, the latch block 1272 of the CPA element 1118 is positioned below the latch 1120 to block actuation of the latch 1120. For example, the latch block 1272 is positioned under the button segment 1145 to mechanically block the latch 1120 from pivoting to an extent necessary to disconnect the latching surface 1121 from the catch 1122 of the tab 1124. Thus, the CPA element 1118 in the inserted position is configured to provide a secondary lock that prevents or at least prohibits the ability for the male and female connectors 1102, 1104 to uncouple from each other until the CPA element 1118 is moved back to the extended position.

In order to subsequently disconnect the male connector 1102 from the female connector 1104, the CPA element 1118 is configured to be moved rearward from the installed position to the extended position, such as by pushing or pulling the raised section 1210 with sufficient force to overcome the soft stop provided by the retention latch 1214 and/or the soft stop provided by the fingers 1206 forward of the protrusions 1232. As the CPA element 1118 is moved rearward, the ramp surface 1256 at the rear edge 1252 is driven against the front edge 1238 of the protrusion 1232. The angle of the front edge 1238 of the protrusion 1232 causes the beams 1192, 1194 to deflect outward. For example, the front edge 1238 may be angled at a complementary angle to the ramp surface 1256 to force the arm 1198 outward.

Figure 11A:
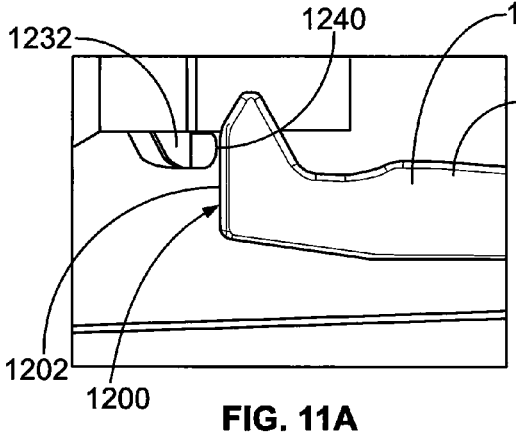
FIGS. 11A-11F show an insertion sequence moving the CPA element from the extended position to the inserted position in accordance with an exemplary embodiment.

FIGS. 11A-11F show an insertion sequence moving the CPA element 1118 from the extended position (FIG. 11A) to the inserted position (FIG. 11F) in accordance with an exemplary embodiment. FIG. 11A shows the CPA element 1118 in the extended position and the beam 1194 in the blocked position. The abutment wall 1202 at the distal end 1200 engages the rear edge 1240 of the protrusion 1232. The protrusion 1232 blocks forward movement of the CPA element 1118 toward the installed position. Until the beam 1194 is moved to a clearance position, the CPA element 1118 is blocked from moving forward.

Figure 11B:
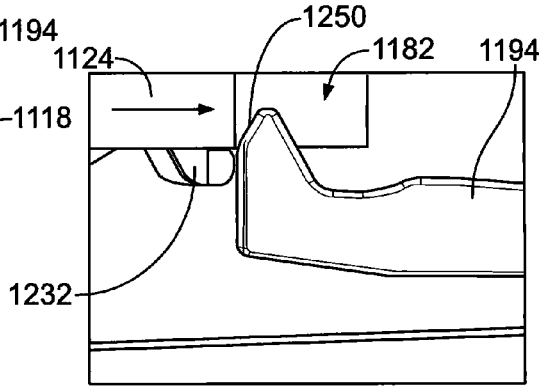

FIG. 11B shows the mating connector 1102 being loaded into the electrical connector 1104. The tab 1124 is shown received in the channel 1182. The tab 1124 is moved rearward in the mating direction as the mating connector 1102 is mated to the electrical connector 1104. FIG. 11B shows the mating connector 1102 partially mated with the electrical connector 1104 as the tab 1124 is yet to engage or deflect the beam 1194.

Figure 11C:
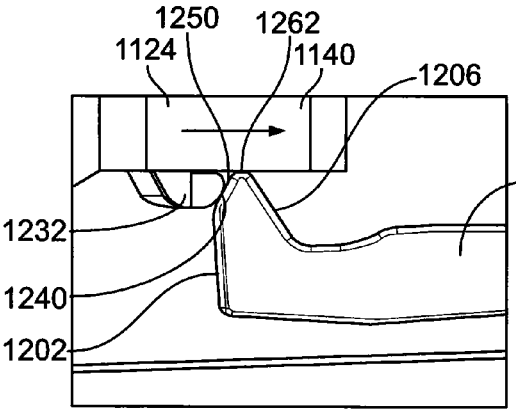

FIG. 11C shows the mating connector 1102 fully mated with the electrical connector 1104. When fully mated, the tab 1124 engages the beam 1194 and forces the beam 1194 to deflect outward to the clearance position. As the tab 1124 is advanced in the mating direction, the ramp 1140 engages the front edge 1250 of the finger 1206. Because the front edge 1250 is angled, the tab 1124 slides along the finger 1206 and forces the finger 1206 outward to the clearance position. In the clearance position, the front edge 1250 of the finger 1206 is aligned with and abuts against the rear edge 1240 of the protrusion 1232. The abutment wall 1202 no longer abuts against the protrusion 1232 but rather is clear of the protrusion 1232, such as to the side of the protrusion 1232.

Figure 11D:
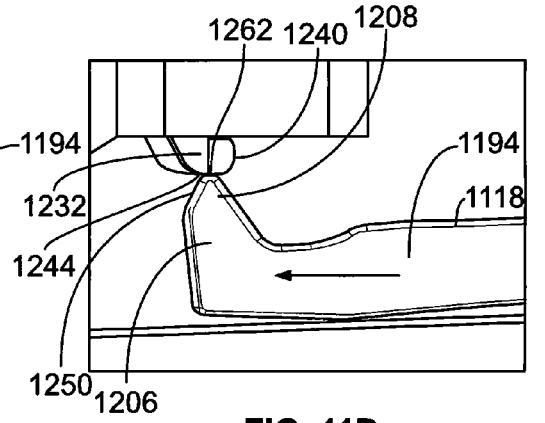

FIG. 11D shows the CPA element 1118 advancing from the extended position to the inserted position. The CPA element 1118 is pushed forward and slides along the protrusion 1232. The curved rear edge 1240 of the protrusion 1232 and the angled front edge 1250 of the finger 1206 allow the relative movement without stubbing. The protrusion 1232 forces the beam 1194 to deflect further outward away from the tab 1124. The inner edge 1262 of the tip 1208 of the finger 1206 rides along the outer edge 1244 of the protrusion 1232.

Figure 11E:
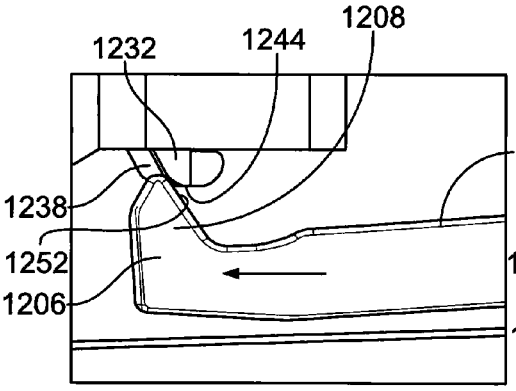

FIG. 11E shows the CPA element 1118 advancing from the extended position to the inserted position. FIG. 11E shows the tip 1208 of the finger 1206 starting to clear the outer edge 1244 of the protrusion 1232 and slide along the front edge 1238 of the protrusion 1232. The rear edge 1252 of the finger 1206 engages the front edge 1238 of the protrusion 1232. The beam 1194 is able to retract back inward as the CPA element 1118 continues to advance toward the inserted position. As the CPA element 1118 approaches the inserted position, the tips 1208 close around the protrusions 1232 and engage the front edges 1238 of the protrusions 1232.

Figure 11F:
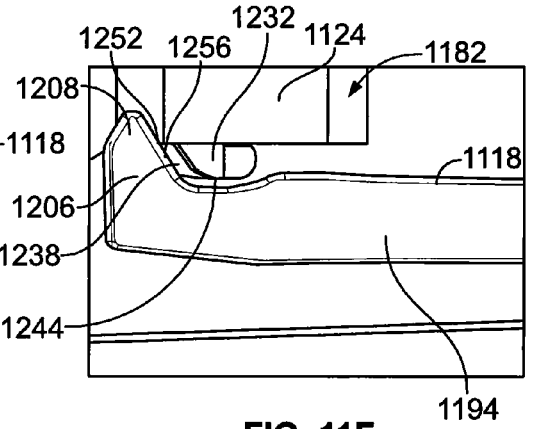

FIG. 11F shows the CPA element 1118 in the inserted position. In the inserted position, the fingers 1206 are forward of the protrusions 1232. The rear edges 1252 of the fingers 1206 engage the front edges 1238 of the protrusions 1232. The rear edges 1252 are forward of the tab 1124 to block the tab 1124. The bias of the beam 1194 forces the beam 1194 to resiliently return towards an undeflected state, such that the beam 1194 moves inward toward the channel 1182. The finger 1206 provides a soft stop that restricts the CPA element 1118 from unintentionally sliding from the inserted position in an extension direction towards the extended position. The finger 1206 optionally may also force the tab 1124 rearward to retain the male connector 1102 in the fully mated position and/or to pull the male connector 1102 from a substantially fully mated position to an absolute fully mated position.

In order to subsequently return the CPA element 1118 to the extended position, the CPA element 1118 is configured to be moved rearward from the installed position to the extended position, such as by pushing or pulling the CPA element 1118 with sufficient force to overcome the holding forces between the CPA element 1118 and the housing 1110. As the CPA element 1118 is moved rearward, the ramp surface 1256 at the rear edge 1252 of the finger 1206 is driven against the front edge 1238 of the protrusion 1232. The angle of the front edge 1238 of the protrusion 1232 causes the beam 1194 to deflect outward and slide along the outer edge 1244 until the tip 1208 is rearward of the protrusion 1232. In such position, the tab 1124 would stop the beam 1194 from fully returning to the blocked position; however, once the male connector 1102 were removed, the beam 1194 would return to the blocked position (FIG. 11A).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a housing having a front end and defining a cavity at the front end that is configured to receive a mating connector therein, the housing having an upper wall above the cavity and a first protrusion extending above the upper wall, wherein the cavity of the housing is oriented along a mating axis such that the mating connector is loaded into the cavity along the mating axis,; and a connector position assurance (CPA) element slidably coupled to the housing along the upper wall between an extended position and an inserted position, the CPA element, in the inserted position, disposed more proximate to the front end of the housing than when the CPA element is in the extended position, the CPA element including a base, an raised section extending from a rear end of the base for actuation of the CPA element between the extended position and the inserted position, and a first beam extending from a front end of the base towards the front end of the housing, the first beam having a first arm and a first finger at a distal end of the first beam, the first finger having an abutment wall at the distal end configured to abut against the first protrusion, the first finger having a tip configured to be engaged by the mating connector when received in the cavity, the tip being deflected from a blocked position to a released position as the mating connector is loaded into the cavity, the distal end engaging the protrusion in the blocked position to block movement of the CPA element from the extended position to the inserted position, the tip being deflected outside of the protrusion to the released position where the tip is able to clear past the protrusion to allow the CPA element to be moved from the extended position to the inserted position, wherein the CPA element being movable parallel to the mating axis between the extended position and the inserted position, the first beam of the CPA element being deflected generally transverse to the mating axis from the blocked position to the clearance position.

2. The electrical connector of claim 1, wherein the tip entirely passes outside of the protrusion as the CPA element moves between the extended position and the inserted position.

3. The electrical connector of claim 1, wherein the distal end of the beam is flat and abuts against the protrusion in the blocked position.

4. The electrical connector of claim 1, wherein the protrusion includes a front edge, a rear edge, an inner edge, and an outer edge, the abutment wall of the first finger abutting against the rear edge in the blocked position, the tip of the first finger riding along the outer edge as the CPA element is moved between the extended position and the inserted position.

5. The electrical connector of claim 4, wherein the rear edge of the protrusion is curved.

6. The electrical connector of claim 1, wherein the arm is twisted to preload the arm against the upper wall.

7. The electrical connector of claim 1, wherein the arm includes an internal preload force forcing the tip downward.

8. The electrical connector of claim 1, wherein the tip includes a front edge configured to engage the mating connector as the mating connector is loaded into the cavity, the front edge of the tip being undercut such that the front edge faces generally downward and forward.

9. The electrical connector of claim 1, wherein the tip includes a bottom edge configured to engage the mating connector as the mating connector is loaded into the cavity, the bottom edge being undercut such that the bottom edge faces generally downward and outward.

10. The electrical connector of claim 1, wherein the tip includes a rear edge engaging a front edge of the protrusion in the inserted position, the rear edge of the tip including a ramp surface, the front edge of the protrusion being angled at a complementary angle to the ramp surface, the ramp surface forcing the arm outward against the front end of the protrusion when the CPA element is moved rearward from the inserted position to the extended position.

11. An electrical connector comprising:

a housing having a front end and defining a cavity at the front end that is configured to receive a mating connector therein, the housing having an upper wall above the cavity and a first protrusion extending above the upper wall; and a connector position assurance (CPA) element slidably coupled to the housing along the upper wall between an extended position and an inserted position, the CPA element, in the inserted position, disposed more proximate to the front end of the housing than when the CPA element is in the extended position, the CPA element including a base, an raised section extending from a rear end of the base for actuation of the CPA element between the extended position and the inserted position, and a first beam extending from a front end of the base towards the front end of the housing, the first beam having a first arm and a first finger at a distal end of the first beam, the first finger having an abutment wall at the distal end configured to abut against the first protrusion, the first finger having a tip configured to be engaged by the mating connector when received in the cavity, the tip being deflected from a blocked position to a released position as the mating connector is loaded into the cavity, the distal end engaging the protrusion in the blocked position to block movement of the CPA element from the extended position to the inserted position, the tip being deflected outside of the protrusion to the released position where the tip is able to clear past the protrusion to allow the CPA element to be moved from the extended position to the inserted position, wherein the CPA element includes a latch block positioned below a latch of the electrical connector in the inserted position to block actuation of the latch.

12. The electrical connector of claim 1, wherein the CPA element includes a retention latch extending from the base to engage the upper wall of the housing, the retention latch being received in a first detent when in the extended position and the retention latch being received in a second detent when in the inserted position.

13. The electrical connector of claim 11, wherein the cavity of the housing is oriented along a mating axis such that the mating connector is loaded into the cavity along the mating axis, the CPA element being movable parallel to the mating axis between the extended position and the inserted position, the first beam of the CPA element being deflected generally transverse to the mating axis from the blocked position to the clearance position.

14. The electrical connector of claim 1, wherein the CPA element further includes a second beam that extends from the base towards the front end of the housing, the first and second beams being spaced apart from one another by a gap, a tab of the mating connector configured to be received at least partially into the gap as the mating connector is received in the cavity, the tab engaging and deflecting the first and second beams laterally outward and away from one other.

15. An electrical connector comprising:

a housing having a front end and defining a cavity at the front end that is configured to receive a mating connector therein, the housing having an upper wall above the cavity having a channel therethrough open at the front end configured to receive a tab of the mating connector, the housing having a first protrusion extending above the upper wall on a first side of the channel and a second protrusion extending above the upper wall on a second side of the channel, the housing having a deflectable latch above the upper wall configured to engage the tab of the mating connector when the mating connector is fully mated to the electrical connector; and a connector position assurance (CPA) element slidably coupled to the housing along the upper wall between an extended position and an inserted position, the CPA element, in the inserted position, disposed more proximate to the front end of the housing than when the CPA element is in the extended position, the CPA element including a base, an raised section extending from a rear end of the base for actuation of the CPA element between the extended position and the inserted position, a first beam extending from a front end of the base towards the front end of the housing, and a second beam extending from the front end of the base towards the front end of the housing and separated from the first beam by a gap aligned above the channel in the upper wall, the gap being configured to receive the tab;

wherein the first beam has a first arm and a first finger at a distal end of the first beam, the first finger having an abutment wall at the distal end configured to abut against the first protrusion, the first finger having a tip configured to be engaged by the tab and being deflected outward away from the gap from a blocked position to a released position as the mating connector is loaded into the cavity, the distal end of the first finger engaging the protrusion in the blocked position to block movement of the CPA element from the extended position to the inserted position, the tip being deflected outside of the first protrusion to the released position where the tip is able to clear past the first protrusion to allow the CPA element to be moved from the extended position to the inserted position; and wherein the second beam has a second arm and a second finger at a distal end of the second beam, the second finger having an abutment wall at the distal end configured to abut against the second protrusion, the second finger having a tip configured to be engaged by the tab and being deflected outward away from the gap from a blocked position to a released position as the mating connector is loaded into the cavity, the distal end of the second finger engaging the protrusion in the blocked position to block movement of the CPA element from the extended position to the inserted position, the tip being deflected outside of the second protrusion to the released position where the tip is able to clear past the second protrusion to allow the CPA element to be moved from the extended position to the inserted position.

16. The electrical connector of claim 15, wherein the tips of the first and second fingers entirely pass outside of the first and second protrusions, respectively, as the CPA element moves between the extended position and the inserted position.

17. The electrical connector of claim 15, wherein the distal ends of the first and second beams beam are flat and abut against the first and second protrusions, respectively, in the blocked position.

18. The electrical connector of claim 15, wherein the first protrusion includes a front edge, a rear edge, an inner edge, and an outer edge, the abutment wall of the first finger abutting against the rear edge in the blocked position, the tip of the first finger riding along the outer edge as the CPA element is moved between the extended position and the inserted position.

19. The electrical connector of claim 15, wherein the first and second arms are twisted to preload the first and second arms against the upper wall.

20. The electrical connector of claim 15, wherein the first and second arms include internal preload forces forcing the tips of the first and second fingers, respectively, downward.

* * * * *